US006471607B2

(12) United States Patent
Hsu

(10) Patent No.: US 6,471,607 B2
(45) Date of Patent: Oct. 29, 2002

(54) SHOCK ABSORBING HANDLE FOR A SPORT RACKET

(76) Inventor: Young-Chen Hsu, No. 121, Section 1, Shen Lin Rd., Taya Hsiang, Taichung Hsien (TW)

( * ) Notice: Subject to any disclaimer, the term of this patent is extended or adjusted under 35 U.S.C. 154(b) by 0 days.

(21) Appl. No.: 09/749,532

(22) Filed: Dec. 28, 2000

(65) Prior Publication Data

US 2002/0086747 A1 Jul. 4, 2002

(51) Int. Cl.[7] ..... A63B 49/08; A63B 49/00

(52) U.S. Cl. ..... 473/523; 473/520; 473/521; 473/549

(58) Field of Search ..... 473/520, 521, 473/523, 549, 568

(56) References Cited

U.S. PATENT DOCUMENTS 546,540 A * 9/1895 Kennedy ..... 473/520
4,609,198 A * 9/1986 Tarr ..... 473/523
5,131,652 A * 7/1992 Peng ..... 473/523
5,516,101 A * 5/1996 Peng ..... 473/523
5,865,694 A * 2/1999 Duong-Van ..... 473/520
6,254,501 B1 * 7/2001 Chang ..... 473/523 X

FOREIGN PATENT DOCUMENTS

DE 1959368 * 11/1970 ..... 473/FOR 183
GB 2149311 * 6/1985 ..... 473/FOR 183
GB 2230458 * 10/1990 ..... 473/FOR 183
GB 2273245 * 6/1994 ..... 473/FOR 183

* cited by examiner

*Primary Examiner*—Raleigh W. Chiu
(74) *Attorney, Agent, or Firm*—Rosenberg, Klein & Lee

(57) ABSTRACT

A sport racket includes a head with a shank extending therefrom and a connection section extends from the shank. A shock absorbing sleeve is mounted to the connection section and a handle is mounted to the sleeve.

4 Claims, 6 Drawing Sheets

SHOCK ABSORBING HANDLE FOR A SPORT RACKET

FIELD OF THE INVENTION

The present invention relates to a handle for a sport racket wherein a soft sleeve is connected between the joint of the handle and the shank so as to absorb shocks.

BACKGROUND OF THE INVENTION

A conventional sport racket generally includes a head with a shank extending from the head and a handle connected to the shank. The head has main strings and cross strings to form a sweet spot which is a preferred area for impacting a ball. An impact shock will be transferred to the user's hand which holds the handle. In order to reduce the affection of the impact, grip strips are used to wrap onto the handle and the grip strips are made of soft material so as to more or less reduce the impact to the hand. However, the diameter of the handle of the racket has its minimum size so as to provide proper structural strength, it is not allowed for the thickness of the grip strips to be a desired or expected thickness. Accordingly, the shock absorbing feature for the conventional sport rackets is not satisfied.

The present invention intends to provide a handle structure for a sport racket and includes a shock absorbing sleeve connected between the shank and the handle to effectively absorb the shocks.

SUMMARY OF THE INVENTION

In accordance with one aspect of the present invention, there is provided a sport racket and comprising a head with a shank extending therefrom and a connection section extends from the shank. A shock absorbing sleeve is mounted to the connection section and a handle is mounted to the sleeve.

The primary object of the present invention is to provide a shock absorbing handle structure for a sport racket by using a flexible sleeve connected between the joint between the handle and the shank of the racket.

These and further objects, features and advantages of the present invention will become more obvious from the following description when taken in connection with the accompanying drawings. which show, for purposes of illustration only, several embodiments in accordance with the present invention.

DETAILED DESCRIPTION OF THE PREFERRED EMBODIMENTS

Figure 1:
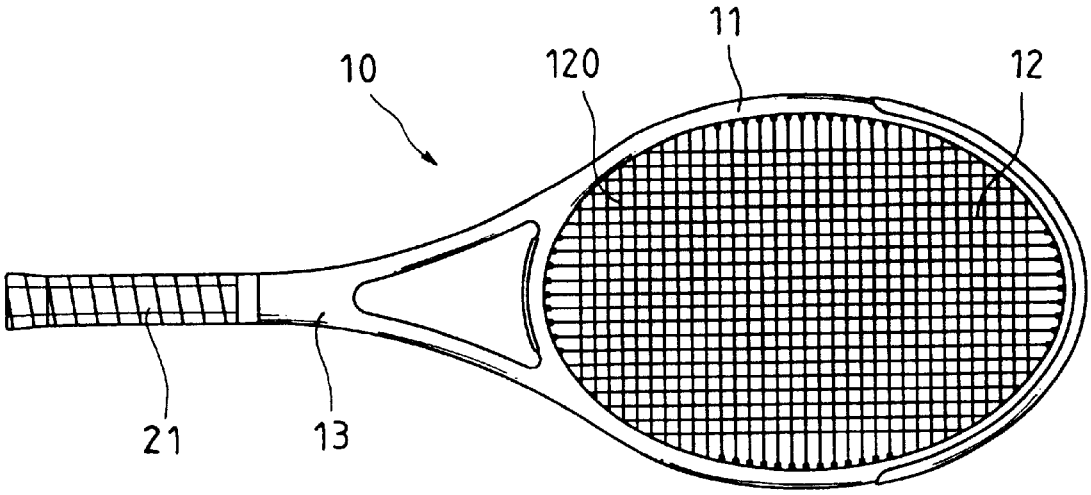
FIG. 1 is a side view to show the sport racket of the present invention.
Figure 2:
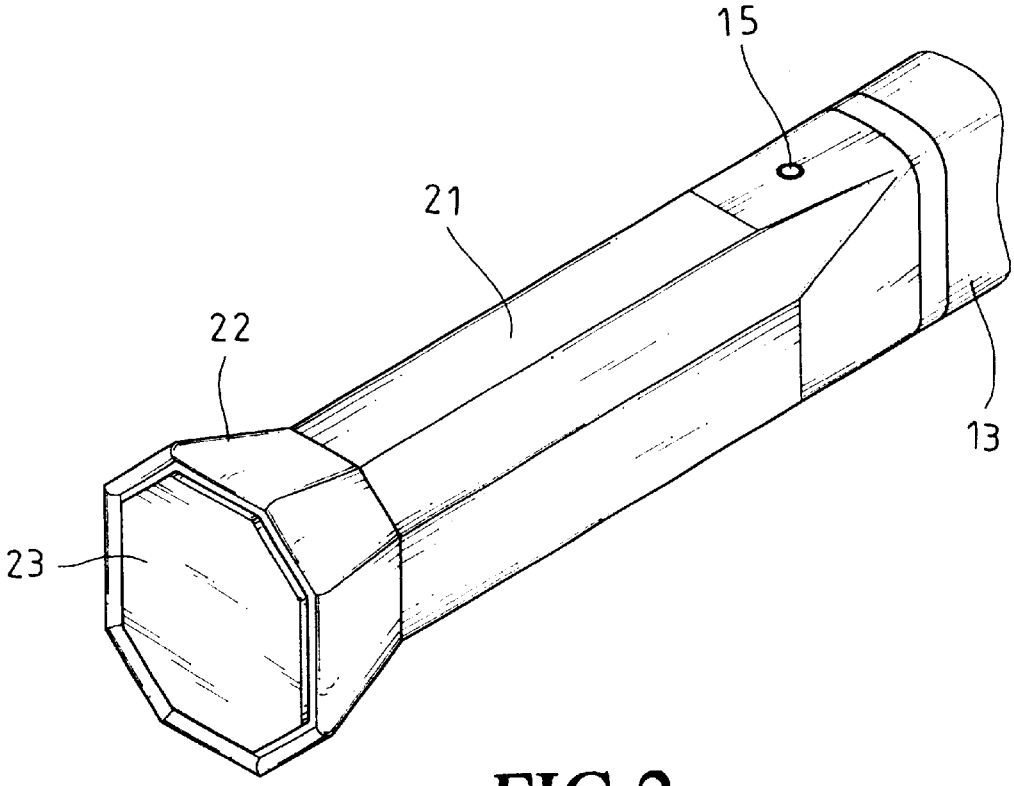
FIG. 2 is a perspective view to show the handle of the sport racket of the present invention.
Figure 3:
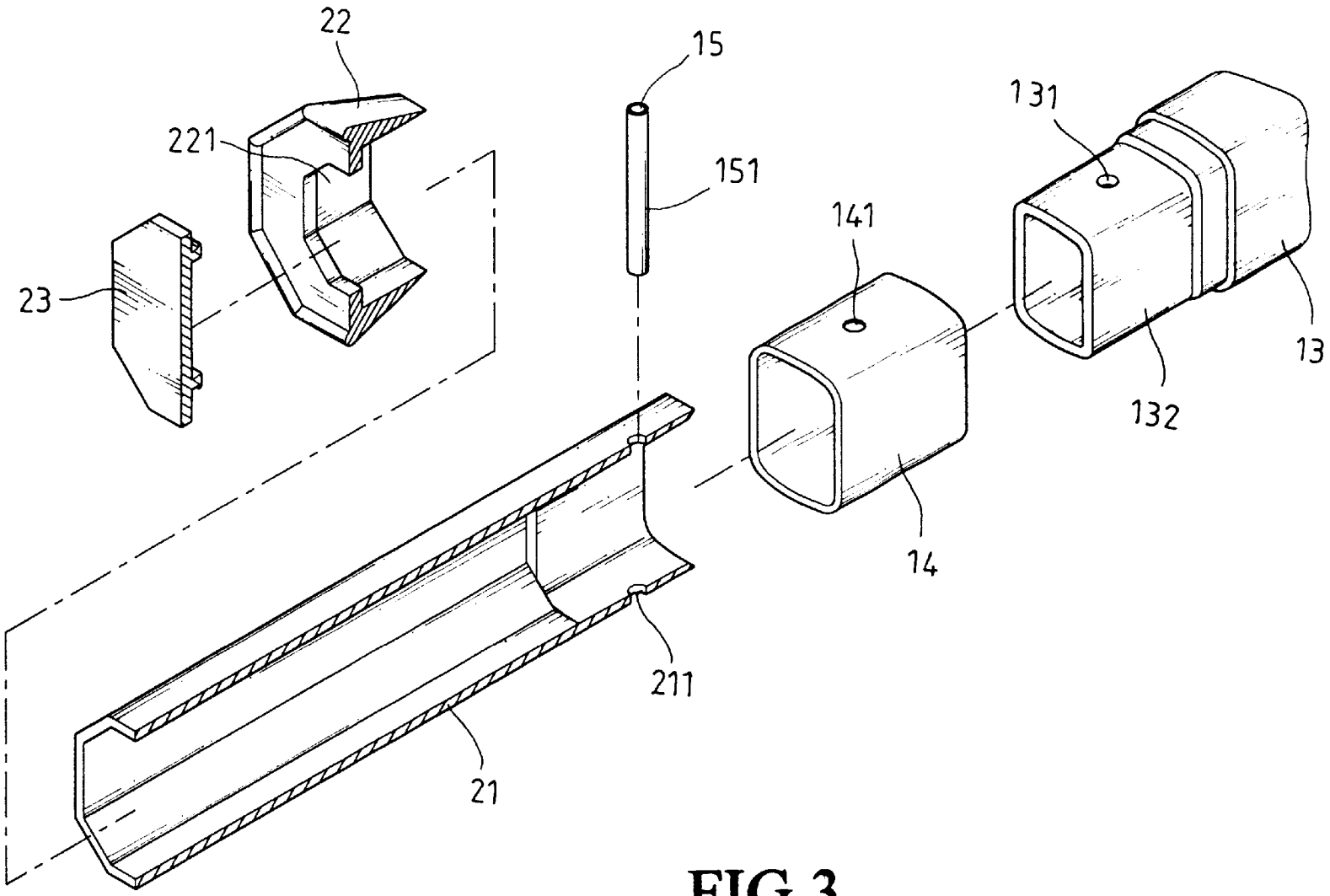
FIG. 3 is an exploded view to show a first embodiment of the handle of the racket of the present invention.
Figure 4:
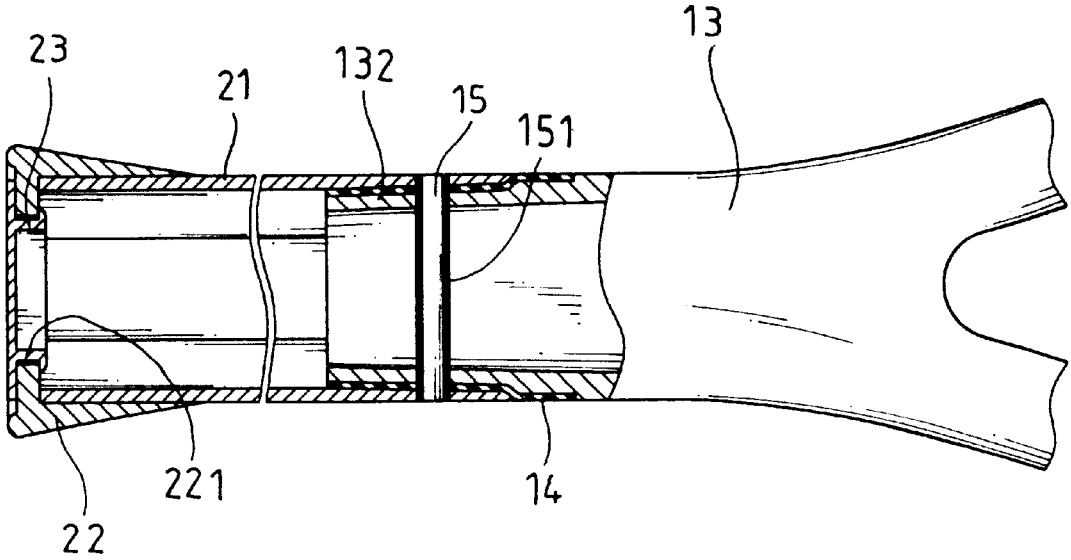
FIG. 4 is a cross sectional view to show the handle of the racket of the present invention as disclosed in FIG. 3.

Referring to FIGS. 1 to 4, the sport racket of the present invention comprises a head 10 having a frame 11 and main strings 12 and cross strings 120 are connected within the frame 11. A shank 13 extends from the frame 11 and a connection section 132 extends from the shank 13. A first hole 131 is defined radially through the connection section 132 and a handle 21 is connected to the connection section 132.

A shock absorbing member such as a sleeve 14 made of rubber, thermoplastic rubber (TPR) or PVE is mounted to the connection section 132, wherein a second hole 141 is defined radially through the sleeve 14. A first end of a handle 21 mounted to the sleeve 14 and a third hole 211 is defined radially through the first end of the handle 21 so that a pin 15 radially extends through the third hole 211 in the handle 21, the second hole 141 in the sleeve 14 and the first hole 131 in the connection section 132 to connect the three items. A flexible coating 151 is mounted to the pin 15 so that the sleeve 14 and the flexible coating 151 absorb shocks transferred from the head 10 when impacting a ball. A second end of the handle 21 is an open end and a butt cap 22 is engaged with the second end of the handle 21. An aperture 221 is defined through the butt cap 22 and a mediate member 23 is engaged with the aperture 221 by a hook-like flange extending from the mediate member 23.

Figure 6:
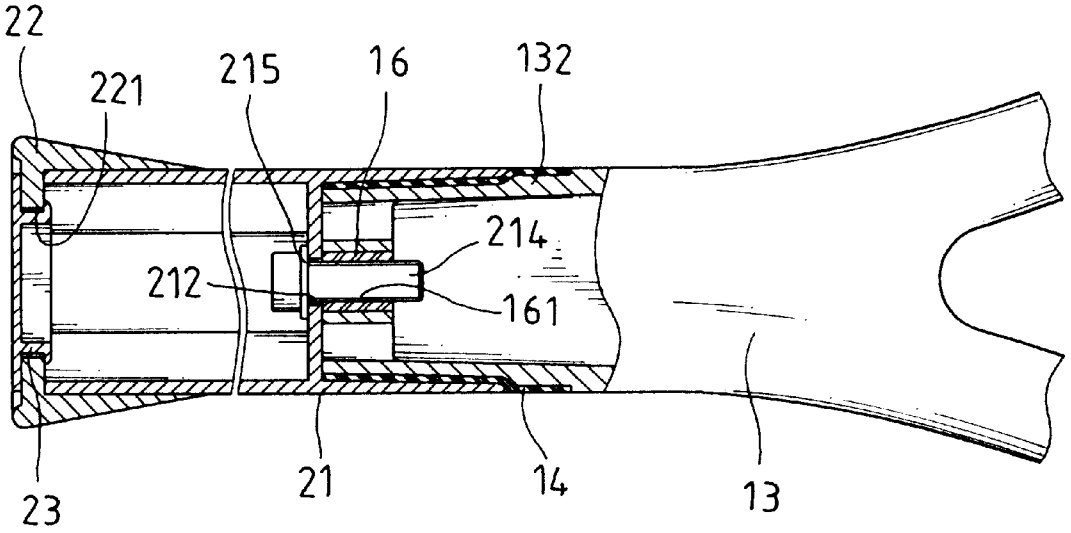
FIG. 6 is a cross sectional view to, show the handle of the racket of the present invention as disclosed in FIG. 5.
Figure 5:
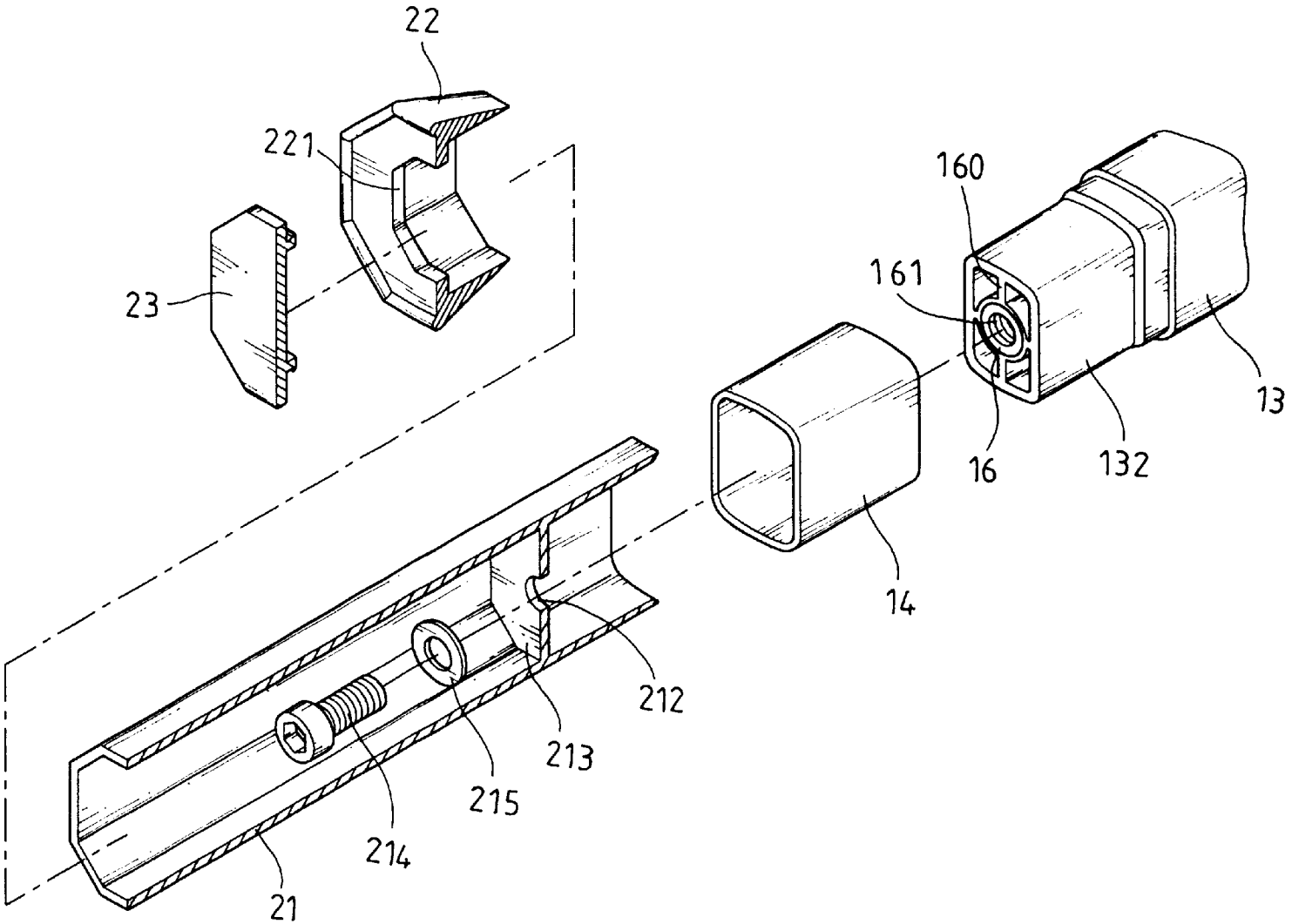
FIG. 5 is an exploded view to show a second embodiment of the handle of the racket of the present invention.
Figure 7:
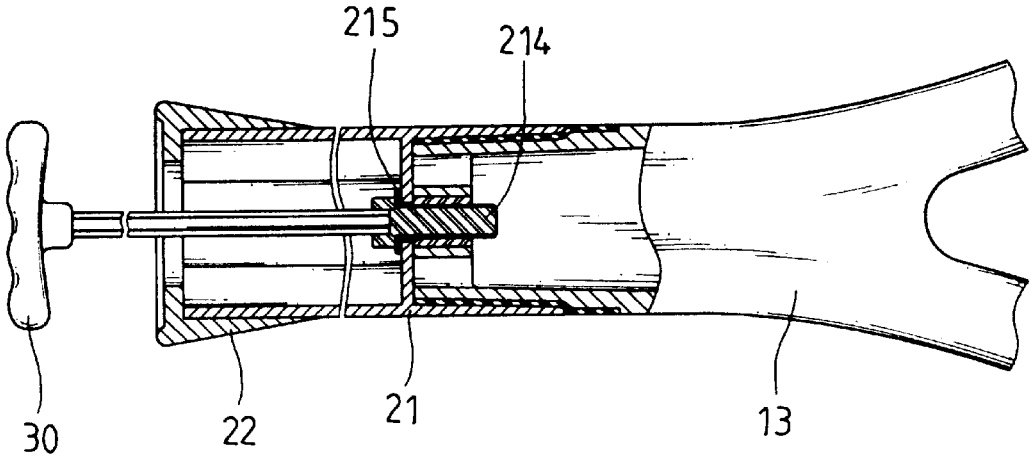
FIG. 7 is a cross sectional view to show a tool extends in the handle to tighten the bolt in the handle of the racket of the present invention as disclosed in FIG. 5.
Figure 8:
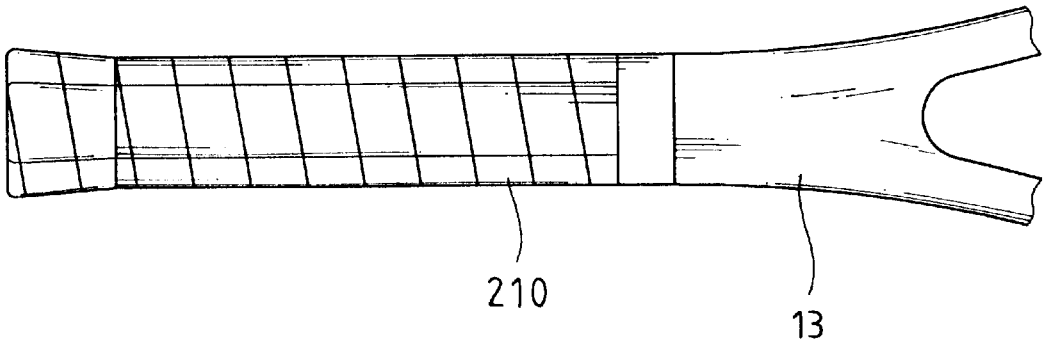
FIG. 8 is a side view to show a longer handle is used in the racket of the present invention.

Referring to FIGS. 5 and 6, another embodiment of the handle comprises a flange 213 extending radially inward from an inner periphery of the handle 21 and a hole 212 is defined in the flange 213. A tubular member 16 is connected in the connection section 132 by ribs 160, the tubular member 16 contacting the flange 213 when the handle 21 is mounted to the connection section 132 with the sleeve 14 located therebetween. A bolt 214 with a washer 215 made of flexible material mounted to the bolt 214 extends through the hole 212 in the flange 213 and is threadedly engaged with a threaded hole 161 in the tubular member 16. The washer 215 is located between a head of the bolt 214 and the flange 213. As shown in FIG. 7, a tool 30 may insert into the handle 21 to operate the bolt 214 via the aperture 221 in the butt cap 22. It is convenient to replace the handle 21 by a longer handle 210 as shown in FIG. 8 by unscrewing the bolt 214.

Figure 9:
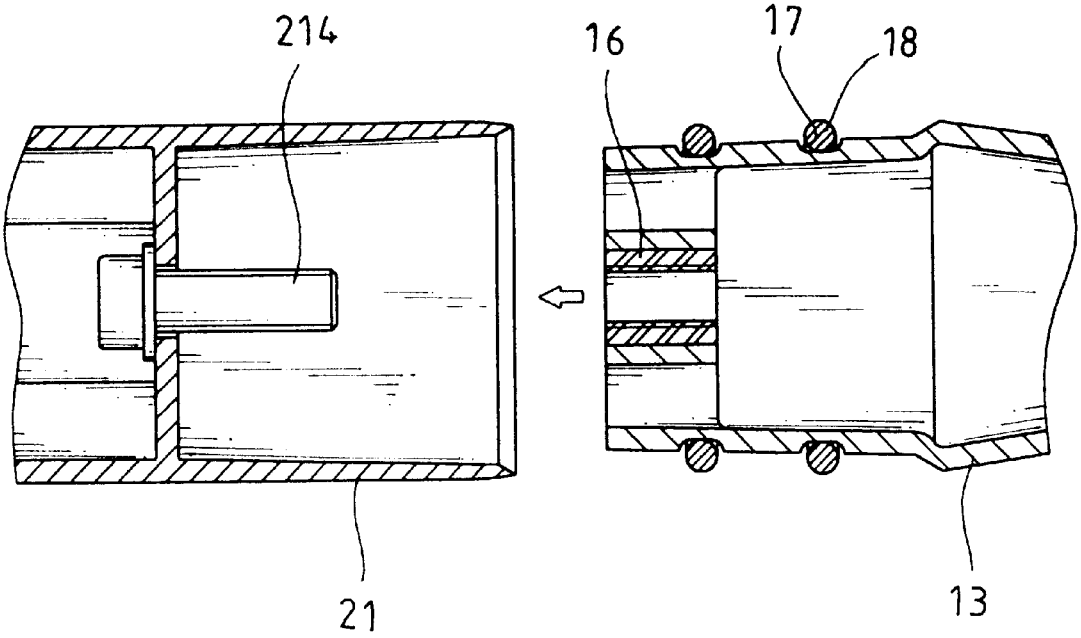
FIG. 9 is an exploded view to show a third embodiment of the handle of the racket of the present invention.
Figure 10:
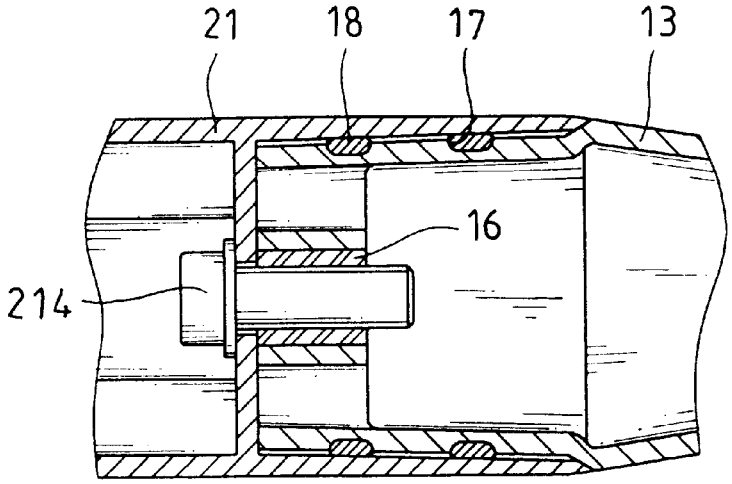
FIG. 10 is a cross sectional view to show the handle disclosed in FIG. 9 of the racket of the present invention.

FIGS. 9 and 10 show that a plurality of grooves 17 are defined in an outer periphery of the connection section 132 and each of the grooves 17 has a ring 18 received therein. The rings 18 are made of flexible material so as to absorb shocks of the racket.

While we have shown and described various embodiments in accordance with the present invention, it should be clear to those skilled in the art that further embodiments may be made without departing: from the scope and spirit of the present invention.

What is claimed is:

1. A sport racket comprising:

a head with a shank extending therefrom;

a connection section extending from said shank;

a shock absorbing member mounted to said connection section;

a first end of a handle mounted to said shock absorbing member;

a pin extending transversely through opposing sides of said handle, opposing sides of said shock absorbing member and opposing sides of said connection section, wherein said pin is coated with a shock absorbing material.

2. A sport racket comprising, a head with a shank extending therefrom;

a connection section extending from said shank;

a shock absorbing member mounted to said connection section;

a first end of a handle mounted to said shock absorbing member;

a flange extending radially inward from an inner periphery of said handle;

a threaded tube embedded in said connection section and in contact with said flange; and a bolt extending through said flange and engaged with said threaded tube.

3. The sport racket as recited in claim 2 further comprising a washer made of flexible material mounted to said bolt and positioned between a head of said bolt and said flange.

4. A sport racket comprising:

a head with a shank extending therefrom;

a connection section extending from said shank;

a shock absorbing member mounted to said connection section;

a first end of a handle mounted to said shock absorbing member;

a plurality of grooves defined in an outer periphery of said connection section, each of said grooves having a ring received therein.

* * * * *